United States Patent [19]

Sawhney et al.

[11] Patent Number: 4,922,701

[45] Date of Patent: May 8, 1990

[54] SYSTEM FOR PRODUCING YARN

[75] Inventors: A. Paul S. Sawhney, Metairie; Craig L. Folk; Kearny Q. Robert, both of New Orleans, all of La.

[73] Assignee: The United States of America as represented by the Secretary of Agriculture, Washington, D.C.

[21] Appl. No.: 373,545

[22] Filed: Jun. 30, 1989

[51] Int. Cl.[5] ..... D02G 3/36; D02G 3/38

[52] U.S. Cl. ..... 57/12; 57/3; 57/6; 57/210; 57/315

[58] Field of Search ..... 57/3, 5, 6, 12, 13, 57/210, 315; 19/244, 258, 288–292

[56] References Cited

U.S. PATENT DOCUMENTS

| | | | |
|---|---|---|---|
| 2,859,583 | 11/1958 | Parker | 57/12 |
| 2,990,673 | 7/1961 | Adkins, Jr. | 57/12 |
| 3,090,081 | 5/1963 | Klein | 19/248 X |
| 3,350,867 | 11/1967 | Morrison et al. | 57/12 |
| 3,778,988 | 12/1983 | White et al. | 57/12 |
| 4,368,611 | 1/1983 | Mainka et al. | 57/6 |
| 4,519,195 | 5/1985 | Belin et al. | 57/3 |
| 4,584,830 | 4/1986 | Faure et al. | 57/6 X |

*Primary Examiner*—John Petrakes

*Attorney, Agent, or Firm*—M. Howard Silverstein; John D. Fado

[57] ABSTRACT

A core/wrap yarn is formed on a conventional ring-spinning yarn system by including a gripper nip immediately downstream from and closely adjacent to the front roller nip of the system; feeding a core strand and at least one wrap stand on each side of the core strand from the front roller nip to the gripper nip, wherein the wrap strands are spaced from the core strand at the front roller nip and converge with the core strand in the gripper nip to wrap around the core strand in the gripper nip so as to form wrapped yarn which then is passed through a ring traveler on to the wind-up system.

13 Claims, 2 Drawing Sheets

SYSTEM FOR PRODUCING YARN

FIELD

This invention relates to production of textile yarns.

PRIOR ART

It is known that core/wrap or wrapped core yarns may be produced by wrapping a fibrous sheath around a continuous-filament core. Alternatively, a continuous filament may be wrapped around a staple fiber core. Still further both the core and wrapping or sheathing may consist of staple fibrous materials, or both may be filament materials. To date, in the production of core/-wrap yarn with fibrous materials the wrapping step has been carried out prior to ring spinning, i.e. during the formation of roving from sliver, thereby producing a core/wrap roving which subsequently must be spun into yarn in a ring spinning step; or during the drawing process, thereby producing a concentrically cored sliver, which subsequently must be roved into roving and spun into yarn in a ring spinning step. To date no practical system has been developed to directly produce core/wrap yarn in a ring-spinning frame from a plurality of unwrapped roving strands.

The following definitions apply to several terms that appear in the specification and claims:

Carding-the use of a carding machine to align, clean and straighten fibers, and to remove very short fibers as well as fine trash to produce sliver.

Drawing-the making parallel and straightening of sliver fibers to improve the uniformity of linear density, usually accomplished in 1, 2, or 3 passages through drawing equipment known as a draw frame or drafting frame. In each passage through a draw frame several sliver strands are combined into a single sliver strand.

Drafting - the process whereby a fiber bundle such as a sliver or roving is extended in length in order to reduce the linear density of the bundle and to increase the parallelization of the fibers. Various forms of drafting are employed in carding, drawing, roving, and ring-spinning.

Sliver-the product produced by carding or drawing, i.e. a very coarse strand of fibers having essentially no twist.

Roving process-conversion of sliver by drafting into a thinner strand called a roving in which a small amount of twist (normally one to two turns per inch) is imparted to the strand. This step is performed only in conjunction with subsequent ring spinning. No other type of spinning presently requires roving prior to spinning.

Ring-spinning process-As used herein, an operation for converting roving into yarn by drafting a roving and imparting twist through use of a ring and a moving traveler on a ring-spinning frame. A small percentage of ring-spinning machines do not require prior formation of roving but instead convert sliver directly into yarn except that the sliver is passed through additional drafting apparatus on the ring frame immediately prior to passage through the ordinary draft rolls/aprons associated with ring spinning.

SUMMARY

A new system is provided for directly producing core/wrap yarn from a plurality of unwrapped rovings. Broadly, the invention comprises feeding a core strand and at least one wrap strand on each side of the core strand from the nip of a pair of front draft rollers of a ring-spinning assembly directly to a gripper nip immediately downstream from and closely adjacent to the nip of the front draft rollers. The core strand travels directly to the gripper nip. The wrap strands which are spaced from the core strand at the front roller nip, converge with the core strand at the gripper nip and wrap around the core strand immediately before the nip so as to form core/wrap yarn in the gripper nip.

The wrapped yarn then is passed through an ordinary ring traveler to the wind-up spindle of the ring-spinning assembly. In this manner, unwrapped roving is converted to core/wrap yarn in a continuous process on the ring-spinning frame.

It is an object of the present invention to produce a new core/wrap yarn having the following advantages and distinctions over previous yarn products:

It is covered at least 90% compared to much lesser percentage of previous core/wrap products.

The core fibers are oriented along the length of the yarn and are positioned in the middle of the cross-section.

Due to unique interlacing of the cover fibers (effected by two strands of drafted rovings, one on each side of the core material), the yarn sheath does not strip from the core at all. Furthermore, the strip resistance is equally good in both directions along the yarn.

The staple-core/cotton-wrap yarn produced with a high tenacity staple fiber is significantly stronger than an equivalent 100% cotton yarn or an equivalent, regular intimate-blend yarn.

The device is capable of producing relatively fine yarns (e.g. yarns of up to 40/1 cotton count or finer).

Both the core as well as cover fibers contribute to the mechanical properties of the yarn produced by the present system; and mechanical properties such as tear strength, tensile strength and abrasion resistance of the fabrics produced from such yarns have exhibited significant improvements.

The staple-core-spun yarns of the present invention are economical compared to existing filament-core yarns mainly because of the lower cost of the staple fibers, compared to filament yarns.

Inferior quality cotton wool manmade fiber or any other fiber can be used in the core, and the premium fiber can be utilized in the cover to produce a premium-looking product.

Many types of novelty yarns and fabrics such as crepe-like denim-like, and differential dye effects can be producing by the spinning technique of the present invention.

It is much easier to piece-up the ends during spinning, when compared to earlier reported spinning techniques.

The staple-core yarns are highly useful for producing textile products where high strength and cotton surface are both desirable and/or critical, such as strong, easy-to-care-for and comfortable apparel of predominantly cotton; certain military fabrics, such as tentage, chambray shirting work uniforms, strong sewing threads with heat-insulation cotton cover and strong pill-resistant fabrics.

Other objects and advantages of the present invention will be obvious from the following detailed description in conjunction with the drawings in which:

FIG. 1 is a perspective view of the overall system of the present invention.

FIG. 1*a* is a preferred embodiment.

FIG. 1*b* is an alternative embodiment.

FIG. 2 is an oblique top-front view of the yarn wrapping and formation zone of the present invention.

FIGS. 2*a* and 2*b* illustrate alternative wrapping designs.

DETAILED DESCRIPTION

Figure 1:
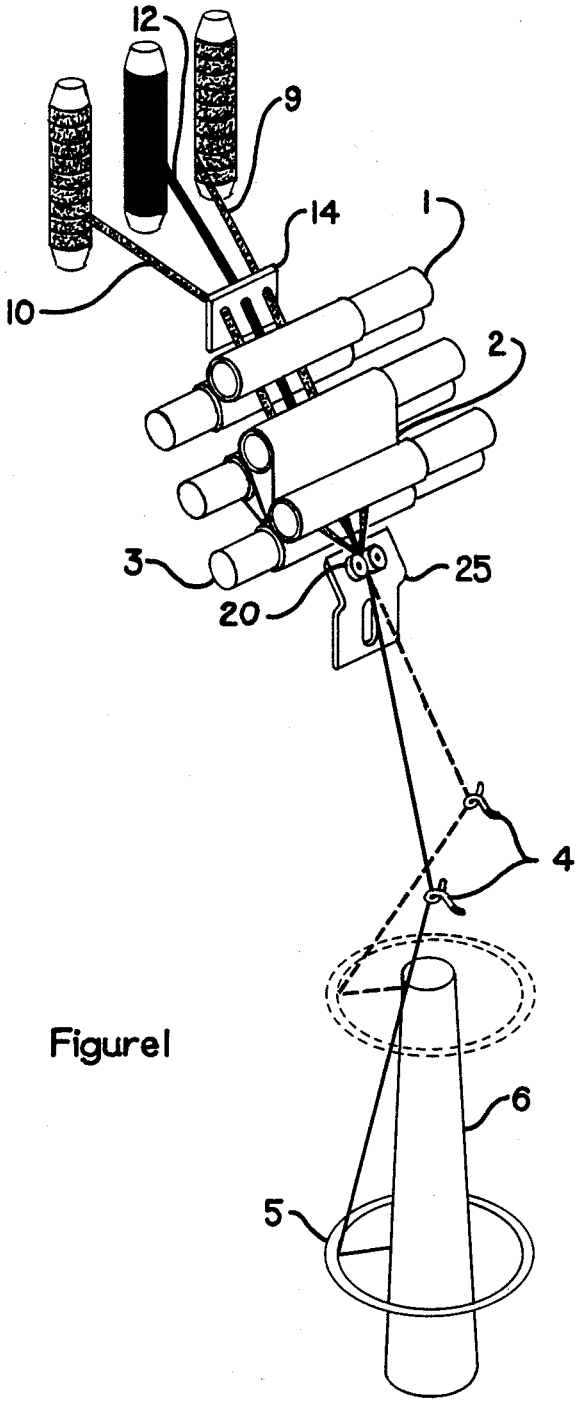

Components of ordinary ring spinning equipment may be employed in the practice of the present invention. These are illustrated in FIG. 1 as rear draft rollers 1, drafting aprons 2 front draft rollers 3, pigtail guide 4, ring 5 and yarn spindle 6. Hereinafter, this combination of elements is referred to as a single spinning system.

In addition, there are at least three bobbins upstream of rear draft rollers 1. Two of these bobbins feed wrap roving 9 and 10 such as cotton roving to rear rollers 1, while the other bobbin feeds core roving 12 such as polyester roving thereto.

Starting materials for the practice of the present invention such as cotton or polyester rovings may be prepared in a conventional manner.

A conventional roving condenser 14 is disposed between the bobbins and rear rollers 1 in order to maintain a space between rovings.

As to the degree of spacing between each wrap and core at the front roller nip, this will depend upon the fiber length being processed, and consequently on the size of the spinning equipment (i.e. short-, mid-, or long-staple spinning equipment). For a conventional cotton (short-staple) spinning system, the space between wrap and core strands may be about 3/32" to 5/32". For long staple fibers such as wool, this dimension may vary from about ¼" to ⅝".

Referring again to FIG. 1, disposed between pigtail guide 4 and front rollers 3 is a pair of opposed, rotatable, spring-loaded rollers 20 which define opposing, curved, convex surfaces that provide a gripper nip. The plane of the gripper nip is perpendicular to the plane of the front roller nip. The rollers may be secured to a bracket 25 which in turn may be secured to the frame of the ring-spinning assembly.

Figure 1A:
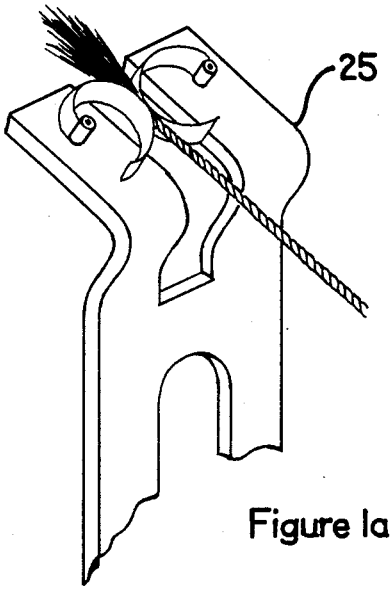

A preferred design is illustrated in FIG. 1*a*. Therein the gripper nip zone is provided by opposing leaf springs.

Figure 1B:
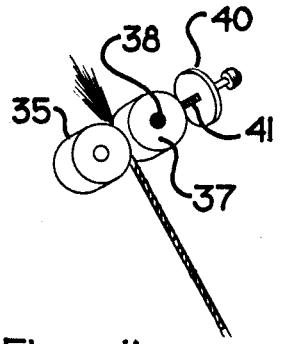

In the alternative embodiment of FIG. 1*b*, the wrapped yarn-forming or gripper zone is provided by two rollers 35 and 37. Roller 35 is fixed. Roller 37 may be moved around its slightly off-center axis 38 by means of adjusting the position of weight 40 on screw 41 that is fixed to roller 37. Since the axis of rotation of roller 37 is slightly off-center, then any rotational movement thereof alters the distance between rollers 35 and 37, thereby altering the gripping pressure therebetween.

Figure 2:
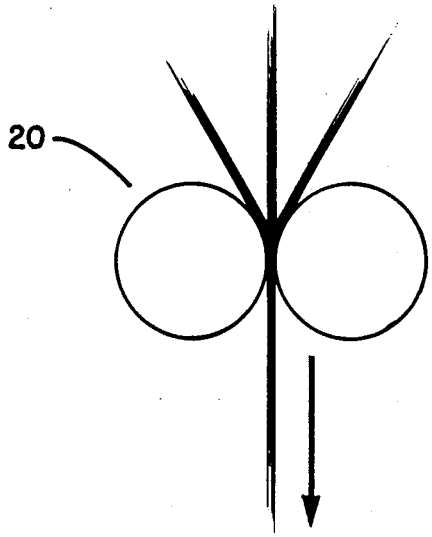

Whatever the gripper design, the gripper nip is aligned with the point of emergence of the core strand from the front roller nip so that the core strand travels in a path perpendicular to the front roller nip directly into the gripper nip. At the same time the wrap strands travel at an angle to the front roller nip and are guided into the gripper nip by the opposing outwardly flared surfaces of the opposed convex surfaces at the entrance of the gripper nip, as can be seen in the top view of FIG. 2.

Figure 2A:
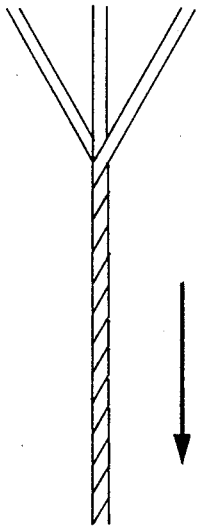
Figure 2B:
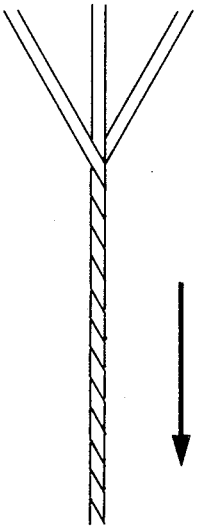

Within the gripper, the wrap strands wrap around the core strand either in the manner of FIG. 2*a* or 2*b*.

The surfaces of the gripper body which directly contact the fibrous strands most preferably are polished.

The distance from the front draft roller nip to the gripper nip should be such that there is essentially no drafting of the core strand between these two points. Thus, the distance between yarn wrapping zone and the front roller nip, measured along the core strand, is less than the length of most of the fibers in the core strand. By avoiding drafting in the core the full yarn tension is maintained in the core strand upstream of the gripper. The loss of this tension otherwise would allow excessive "twist" upstream of the gripper assembly and would result in barber-poling and less than subsequent full coverage of the core strand by the wrap strands.

With regard to fiber length in the wrap strands, the distance from the front draft-roller nip to the gripper nip should be such that there is no drafting of the longest fibers in the wrap strands (e.g., for cotton, shorter than the so-called "2.5% span length" or "staple" length) but that there is drafting of some of the shorter fibers therein. In other words the distance along each wrap strand from the point of emergence of each wrap strand at the front roller nip to the yarn formation point at the gripper nip is greater than the shortest fiber length therein but less than the staple length (e.g., about 50–80% of the staple length for cotton or wool wrapper). In the case of cotton wrapper fibers, the distance along the wrap strands measured from front roller nip to yarn formation typically is about ½" to ⅞".

Thus, in the practice of the present invention, the fibers, after emerging from the nip of the front rollers, are loose with no twist to hold them together except for the slight twist imparted to the core-strand-fibers during their passage from front draft roller nip to gripper nip by twist flowing back upstream of the gripper.

In addition to its distance from the front roller nip, the gripper nip generally is positioned so that the axes of the gripper rolls are normal to the plane which is tangent to both front drafting rollers and contains the line of contact between the front rollers.

The gripping force within the gripper nip is adjusted so that twist is imparted to the core strand prior to wrapping. A force within 6 grams to 12 grams generally will be suitable for many strands. The exact magnitude of the gripping force, which varies from yarn to yarn, is a function of yarn count and spinning tension. The gripping force (normal to the yarn axis) produces a frictional drag on the yarn at the gripping point. This drag is essentially the spinning tension, i.e., the tension of the yarn between the gripper and ring/traveler. Excessive gripping force should be avoided because it will cause an "end down" (break) when the spinning tension exceeds the strength of the core component of the yarn. Insufficient gripping force should be avoided because it will allow too much of the twist to flow back up into the fiber assemble zone between the gripper nip and the front roller nip, which leads to the undesirable barber-pole effect. Generally the twist should flow back about 20% to 40% of the distance along the core strand from gripper nip to front roller nip.

The following are exemplary gripping forces for specific materials and wind-up spindle speeds:

| | Wrap Material | Core Material | Yarn Count | Spindle Speed | Grip Force |
|---|---|---|---|---|---|
| 1. | Cotton | Polyester | 20/1 | 10,000 rpm | 10 grams |
| 2. | Cotton | Polyester | 40/1 | 10,000 rpm | 6 grams |
| 3. | Cotton | Cotton | 20/1 | 8,000 rpm | 8 grams |

The radius of curvature of surfaces at the gripper nip generally will range from about ½" to 1" depending upon yarn counts and types. For a 20/1 yarn composed of cotton-wrap/polyester-core, a radius of curvature of ½" is suitable.

With regard to the operational speeds of the system of the present invention, spindle speed may be the same as that employed to spin yarn of a given linear density and twist multiple, in the ordinary manner, from a roving having the same overall blend composition and combined linear density as the three rovings (two wrapper plus core). In this case approximately the same twist gear and the same draft gear ratio would be used and the same linear density yarn produced. The three rovings creeled per position in the present invention, however, would each have to be prepared with linear densities, on the average, one-third of the linear density of the conventional roving.

Alternately, a separate approach would be to use three rovings each having the same linear density as the comparable conventional single roving. In this case, however, the draft gear would be selected to increase the draft by a factor of three because three times as much roving (three rovings versus one roving) is pieced into the drafting zone. The same twist gear and spindle speed would produce the same yarn linear density and twist multiple as in the conventional single-roving case.

A third and more practical approach would combine a change in linear density of the rovings with a change in draft gearing. One possible combination would be to reduce the roving linear densities by a factor of two, and increase the draft by a factor of 1.5. For instance, if a 1-hank roving is normally used with a draft of 28 to produce Ne 28 yarn in the conventional way, then three 2-hank rovings (one core and two wrapper rovings of different composition) could be used with a draft of 42 to produce Ne 28 core/wrap yarn from the present invention. Once again the spindle speed and twist gear ratio of the machine would be the same, as would the resultant twist multiple of the yarn produced.

Many other practical combinations exist. In cotton ring spinning, it is generally desirable to keep the draft below 50, and the roving linear density heavier than three hank. The exact combination would be chosen by the experienced textile technologist based on the available equipment and the overall processing requirements. Variations in the twist multiple, production rate, and yarn count are accomplished by purely conventional manipulation of the textile relationships between the variables of roving linear density, ring size, spindle speed, twist and draft gearing, traveler weight, and so forth. The following are general spinning parameters for a 28-tex, 67% cotton/33% polyester-staple-core yarn produced by the system of the present invention:

polyester roving (1)=2-hank (1.5"; 1.2 denier; and 6 g/denier)
cotton rovings (2)=2-hank (1-1/16" staple; Acala):
combined hank of rovings=0.67
total draft=42
spindle speed (rpm)=9,100
twist multiple=4.00
traveller=#6 (1.6 grains)
relative humidity=51
temperature (C)=20

The present invention may be employed to wrap fibrous materials around continuous filament core materials such as continuous filament polyester, as well as around staple core material. When such continuous filament materials is employed as the core strand instead of being introduced into the drafting system through the back rolls the filament core is fed into the drafting system immediately behind the front rollers in between the wrapper strands. The operational speeds of the drafting zone and spindle speed are the same as for a similar system employing staple core material of the same linear density. The resulting product made from continuous polyester filament core strand and cotton wrap quite surprisingly has the same excellent strip resistance as a core/wrap yarn having a staple-core strand.

In still another operational arrangement, the gripper means or wrapped yarn-formation nip, may be rotated 90 degrees so that the gripper nip is not perpendicular to the front roller nip, but rather is parallel to the front roller nip and lies in the plane tangent both to the front rollers and to the gripper surfaces. In this system, the outwardly flared opposing surfaces of the opposed, convex surfaces at the entrance to the gripper nip no longer provide means to guide the wrap strands to the nip. When two wrap strands are present in such an embodiment, the spacing between the core strand and one of the wrap strands at the front roller nip preferably is different than the spacing between the core strand and the other wrap strand. In particular the spacing between rovings 9 and 12 of FIG. 1 would be slightly less than the spacing between rovings 10 and 12 in the case of a "Z" twist at yarn formation (FIG. 2*a*), and vice-versa in the case of "S" twist (FIG. 2*b*). Generally, the lesser spacing is about 70–80% of the greater spacing between centerlines of respective strands. This unequal spacing may be accomplished by a condenser disposed upstream of the front roller nip, that has unequal spacing between its condenser holes.

We claim:

1. In a ring-spinning yarn assembly including a drafting hand having a pair of front rollers defining a nip therebetween, and a wind-up spindle downstream from said nip further including means defining a gripper nip immediately downstream from and closely adjacent to said front roller nip; means to feed a core strand and at least one wrap strand on each side of said core strand from said front roller nip to said gripper nip; wherein said wrap strands are spaced from said core strand at said nip and converge with said core strand in said gripper nip to wrap around said core strand in said gripper nip so as to form a wrapped yarn.

2. The apparatus of claim 1 wherein said means defining said gripper nip comprises opposed, curved, convex surfaces.

3. The apparatus of claim 2 wherein said opposed convex surfaces are defined by opposing leaf springs.

4. The apparatus of claim 2 wherein said opposed convex surfaces are defined by a pair of spring-loaded rotatable rollers.

5. The apparatus of claim 2 wherein said opposed convex surfaces are defined by first and second opposing rollers, wherein said first roller is fixed; wherein said second roller includes an off-center axis; and means to move said second roller around said off-center axis.

6. A method of forming core/wrap yarn on a ring-spinning system that includes a wind-up spindle assembly and a drafting frame having a pair of front rollers comprising a. passing a core strand and wrap strands on each side of said core strand from the nip of said pair of front rollers of said ring-spinning system to a gripper nip immediately downstream and closely adjacent to said front roller nip, wherein said wrap strands are spaced from said core strand at said front roller nip wherein said core strand travels directly to said gripper nip in a pathway perpendicular to said front roller nip, wherein said wrap strands converge with said core strand in said gripper nip;

b. wrapping said wrap strands around said core strand in said gripper nip to form wrapped yarn; and c. passing said wrapped yarn from said gripper nip to said system's wind-up spindle assembly.

7. The method of claim 6 wherein said core strand is drafted from a roving of different composition than said wrap strands.

8. The method of claim 7 wherein said gripper nip comprises a zone defined by opposing, curved convex surfaces.

9. The method of claim 6 wherein said wrap strands are guided from said front roller nip into said gripper nip.

10. The method of claim 9 wherein said core strand is drafted from a roving of different composition than said wrap strands.

11. A method of forming core/wrap yarn on a ring-spinning system that includes a wind-up spindle assembly and a drafting frame having a pair of front rollers comprising a. passing a continuous filament core and wrap strands on each side of said core from the nip of said pair of front rollers of said ring-spinning system to a gripper nip immediately downstream and closely adjacent to said front roller nip, wherein said gripper nip comprises a zone defined by opposing, curved convex surfaces, wherein said wrap strands are spaced from said core at said front roller nip, wherein said core travels directly to said gripper nip in a pathway perpendicular to said front roller nip, wherein said wrap strands converge with said core in said gripper nip;

b. wrapping said wrap strands around said core in said gripper nip to form a wrapped yarn; and c. passing said wrapped yarn from said gripper nip to said system's wind-up spindle assembly.

12. The method of claim 11 wherein said core is continuous filament polyester.

13. The method of claim 12 wherein said wrap strands are cotton.

* * * * *